US011730665B1

(12) United States Patent
Huang et al.

(10) Patent No.: US 11,730,665 B1
(45) Date of Patent: Aug. 22, 2023

(54) PENIS MASSAGER

(71) Applicant: Junpeng Wu, Shenzhen (CN)

(72) Inventors: Tenghui Huang, Guangdong (CN); Junpeng Wu, Shenzhen (CN); Zhixu Yang, Guangdong (CN)

( * ) Notice: Subject to any disclaimer, the term of this patent is extended or adjusted under 35 U.S.C. 154(b) by 0 days.

(21) Appl. No.: 18/119,859

(22) Filed: Mar. 10, 2023

(30) Foreign Application Priority Data

Mar. 8, 2023 (CN) ..... 202320430037.2

(51) Int. Cl.
*A61H 19/00* (2006.01)

(52) U.S. Cl.
CPC ..... *A61H 19/32* (2013.01); *A61H 2201/0153* (2013.01); *A61H 2201/0207* (2013.01); *A61H 2201/1654* (2013.01)

(58) Field of Classification Search
None
See application file for complete search history.

(56) References Cited

U.S. PATENT DOCUMENTS

2015/0196454 A1* 7/2015 Levy ..... A61H 19/32 600/38
2021/0113424 A1* 4/2021 Yates ..... A61F 5/41

FOREIGN PATENT DOCUMENTS

DE 202017005314 U1 * 2/2018

* cited by examiner

*Primary Examiner* — Thaddeus B Cox

(57) ABSTRACT

A penis massager includes a housing and an sleeve. The housing is provided with an accommodating space, and a power source and a circuit board electrically connected to the power source are received in the accommodating space. The sleeve is removably mounted in the accommodating space, one end of the sleeve is concaved to form a interior volume for containing the penis. A vibrating apparatus is arranged in the sleeve and electrically connected to the circuit board for generating a mechanical vibration.

20 Claims, 13 Drawing Sheets

PENIS MASSAGER

CROSS-REFERENCE TO RELATED APPLICATIONS

This application claims priority to Chinese Patent Application No. 202320430037.2 filed on Mar. 8, 2023, the entire contents of which are hereby incorporated by reference.

TECHNICAL FIELD

The present invention relates to the technical field of massage devices, more particularly relates to a penis massager.

BACKGROUND

Penis massagers are configured for simulating a vaginal environment and providing a massaging stimulation to the male genitalia. Generally, the penis massager includes a housing, a soft sleeve being movably mounted in a housing, and a vibrating apparatus for driving the sleeve to vibrate during the sexual intercourse. However, the sleeve needs to be cleaned after use and the vibrating apparatus should be removed from the sleeve during clean the sleeve, which is relatively troublesome. Further, a vibration range of the vibrating apparatus is relatively narrow, and the stimulation to the user is insufficient, and the user experience is poor.

SUMMARY

An object of an embodiment of the present invention is to provide a penis massager which is easy to clean and is better in user experience.

In order to achieve the above-mentioned object, the present invention provides a penis massager, including:

a housing provided with an accommodating space, a power source and a circuit board electrically connected to the power source being received in the accommodating space;

a sleeve being removably mounted in the accommodating space, one end of the sleeve being concaved to form an interior volume for accommodating the penis; and a vibrating apparatus being provided in the sleeve, the vibrating apparatus being electrically connected to the circuit board for generating a mechanical vibration.

Compared with the prior art, the penis massager provided by the present invention has the beneficial effects that: the penis massager of the present invention is configured to set the vibrating apparatus in the sleeve, so that the vibrating apparatus and sleeve are integral, which makes the vibrating apparatus need not to be removed when the sleeve is cleaned. Thus, the penis massager is more convenient to clean after being used. In addition, the vibrating apparatus arranged in the sleeve, compared with a structure that the vibrating apparatus is arranged externally, is wider and more obvious in vibration range, thereby forming stronger stimulation and improving the user experience.

BRIEF DESCRIPTION OF THE DRAWINGS

In order to more clearly explain technical solutions in embodiments of the present invention, accompanying drawings required to be used in the embodiments or the description of the prior art will be briefly introduced below. Apparently, the accompanying drawings in the following description are only some embodiments of the present invention. For those ordinarily skilled in the art, other accompanying drawings may be obtained from these accompanying drawings without paying any creative labor.

DESCRIPTION OF THE EMBODIMENTS

Figure 1:
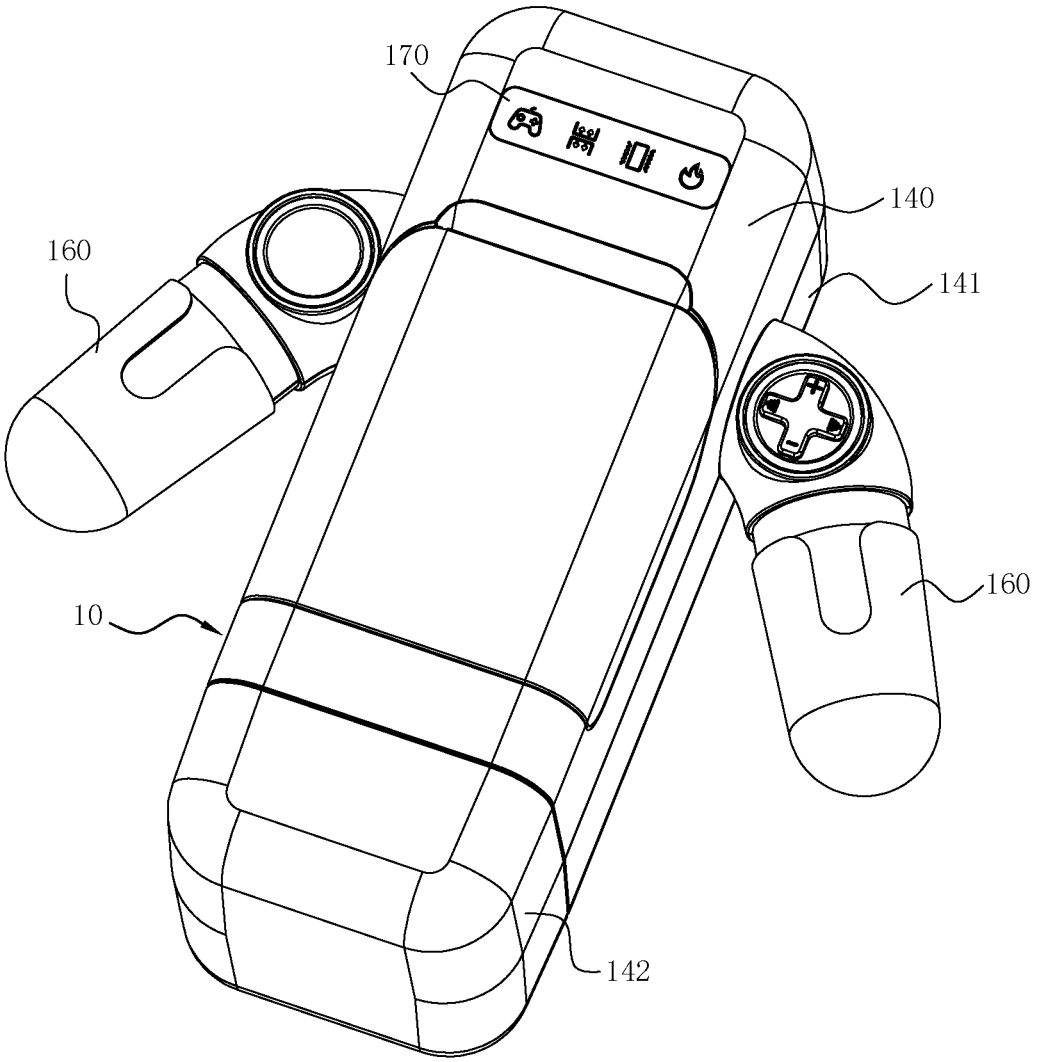
FIG. 1 is a perspective view of a penis massager according to an embodiment of the present invention.

In order to make technical problems, technical solutions and beneficial effects to be solved in the present invention clearer, the present invention will be further described below in detail in conjunction with accompanying drawings and embodiments. It should be understood that specific embodiments described herein are only used to explain the present invention and not to limit the present invention.

It should be noted that when an element is referred to as "fixed to" or "arranged on" another element, it can be directly or indirectly on another element. When an element is referred to as "connected to" another element, it can be directly or indirectly connected to another element.

It should be understood that the orientational or positional relationship indicated by terms "length", "width", "up", "down", "front", "back", "left", "right", "vertical", "horizontal", "top", "bottom", "inside", "outside", and the like is based on the orientational or positional relationship shown in the accompanying drawings, and is only for the sake of describing the present invention and simplifying the description instead of indicating or implying that the apparatus or element referred to must have a specific orientation, and must be constructed and operated in a specific orientation, so it cannot be understood as a limitation of the present invention.

Also, terms "first" and "second" are only used for describing purposes, and cannot be understood as indicating or implying relative importance or implying the number of technical features indicated. Therefore, features defined with "first" and "second" can explicitly or implicitly include one or more of these features. In the description of the present invention, "a plurality of" means two or more, unless otherwise specified.

With reference to FIG. 1 to FIG. 4 together, a penis massager provided by an embodiment of the present invention is shown. The penis massager includes a housing 10 and a sleeve 20. Preferably, the sleeve 20 is made of soft material, such as soft rubber. The housing 10 is provided with an accommodating space 110, and a power source 120 and a circuit board 130 are arranged in the accommodating space 110. The circuit board 130 is electrically connected to the power source 120. The sleeve 20 is removably mounted in the accommodating space 110. One end of the sleeve 20 is concaved inwards to form an interior volume 210 for accommodating the penis. An opening 201 communicating with the interior volume 210 is formed on a front end of the sleeve 20 for inserting of the penis therein, and a rear end of the sleeve 20 is closed. The sleeve 20 is provided with a plurality of bulges on an inner wall surface of the interior volume 210 to enhance massage to the penis.

The housing 10 includes a top housing 140, a bottom housing 141 and an end cover 142. The top housing 140 and bottom housing 141 are connected to each other and cooperatively form an outer housing which encircles the opening at the front end, and the end cover 142 covers the opening of the outer housing. When the end cover 142 is opened, the opening 201 in the front end of the sleeve 20 is exposed out of the outer housing. An aperture 143 for picking-and-placing the sleeve 20 is defined in the top of the top housing 140, and a top cover 150 is removably connected to the aperture 143. The top cover 150 is in snap-fit connection with the top housing 140, and an avoidance slot 145 for facilitating detaching of the top cover 150 from the top housing 140 is defined in a top surface of the top housing 140. An fixing member 220 is mounted at a position close to a front end of the sleeve 20, and the fixing member 220 may be held and rotate downwards after the top housing 140 is taken out of the top cover 150, so that the sleeve 20 may be pulled out of the housing 10.

Figure 5:
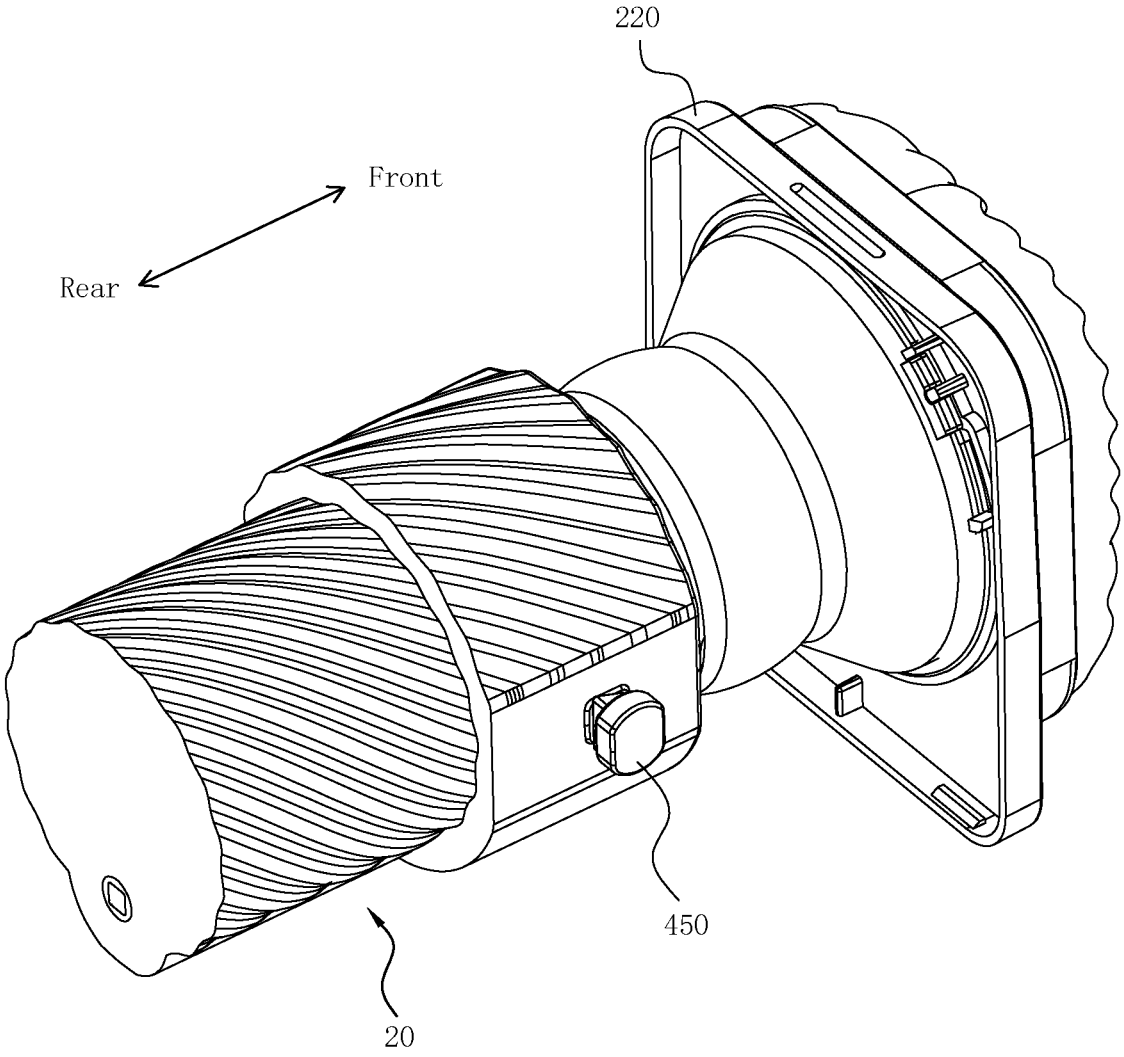
FIG. 5 is a perspective view of a sleeve of the penis massager of FIG. 4.
Figure 6:
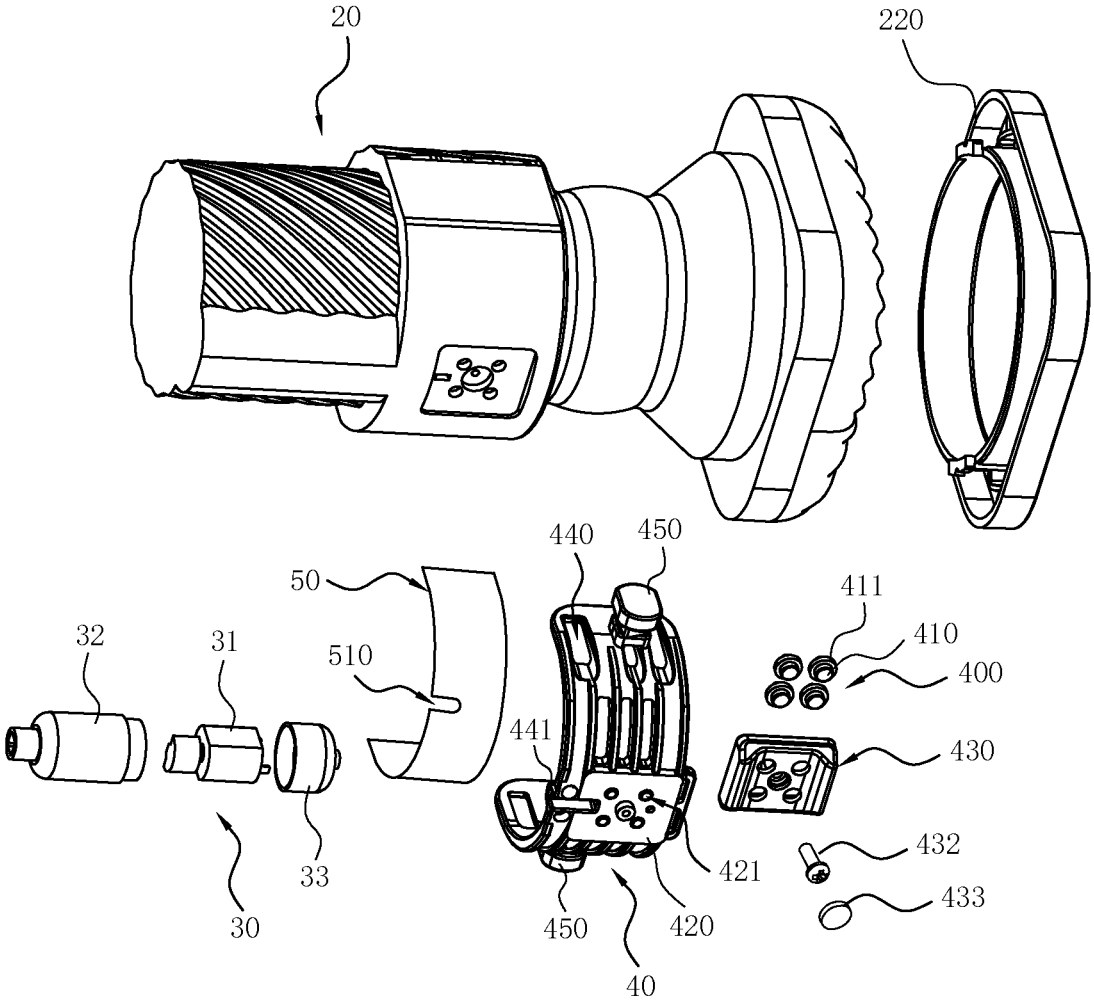
FIG. 6 is an exploded view of the sleeve of FIG. 5.
Figure 7:
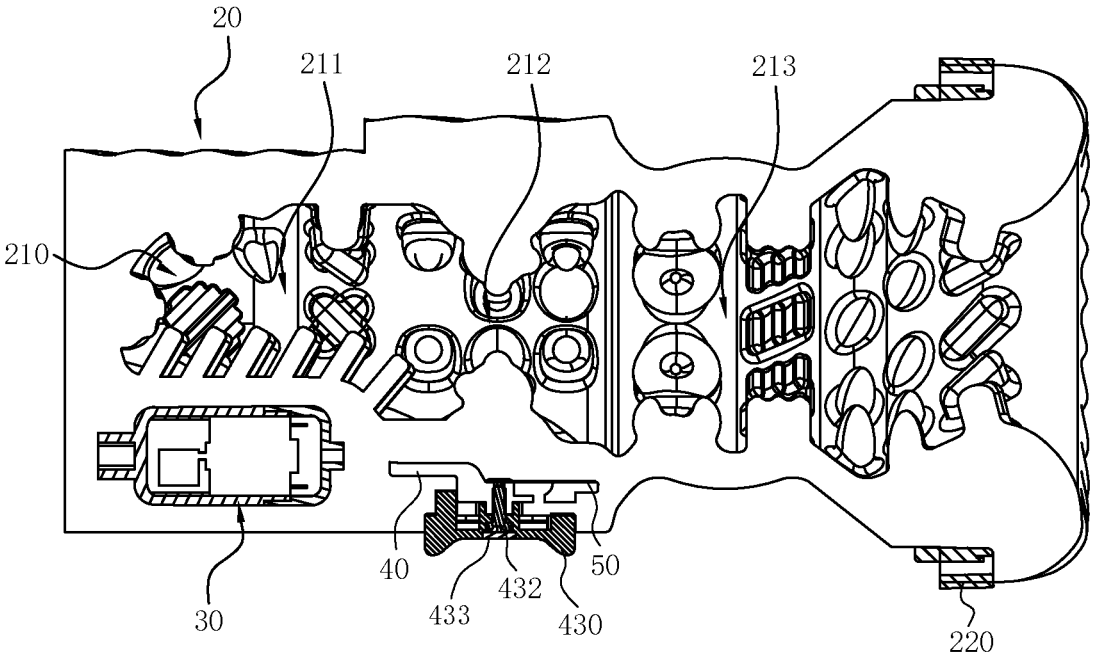
FIG. 7 is a sectional view of the sleeve of FIG. 5.

With further reference to FIG. 5 to FIG. 7, a vibrating apparatus 30 is provided in the sleeve 20. The vibrating apparatus 30 may be specifically arranged in a side wall of the sleeve 20 and is close to a rear end of the sleeve 20. The vibrating apparatus 30 may also be arranged on other positions of the sleeve 20, such as the top of the sleeve 20. The vibrating apparatus 30 may be a motor 31, which is electrically connected to the circuit board 130 and is used for generating a mechanical vibration to drive the sleeve 20 to vibrate together.

In the present embodiment, the motor 31 is embedded in the side wall of the sleeve 20. During production, the motor 31 and the sleeve 20 are integrally molded by injection to form an integral structure. Thus, the penis massager after being used may be cleaned without removing the motor 31 from the sleeve 20, facilitating cleaning operation. At the same time, by means of the integral structure that the vibrating apparatus 30 is embedded in the side wall of the sleeve 20, the sleeve 20 is wider in vibration range and more obvious in vibration effect, and thus the user experience is improved.

Figure 3:
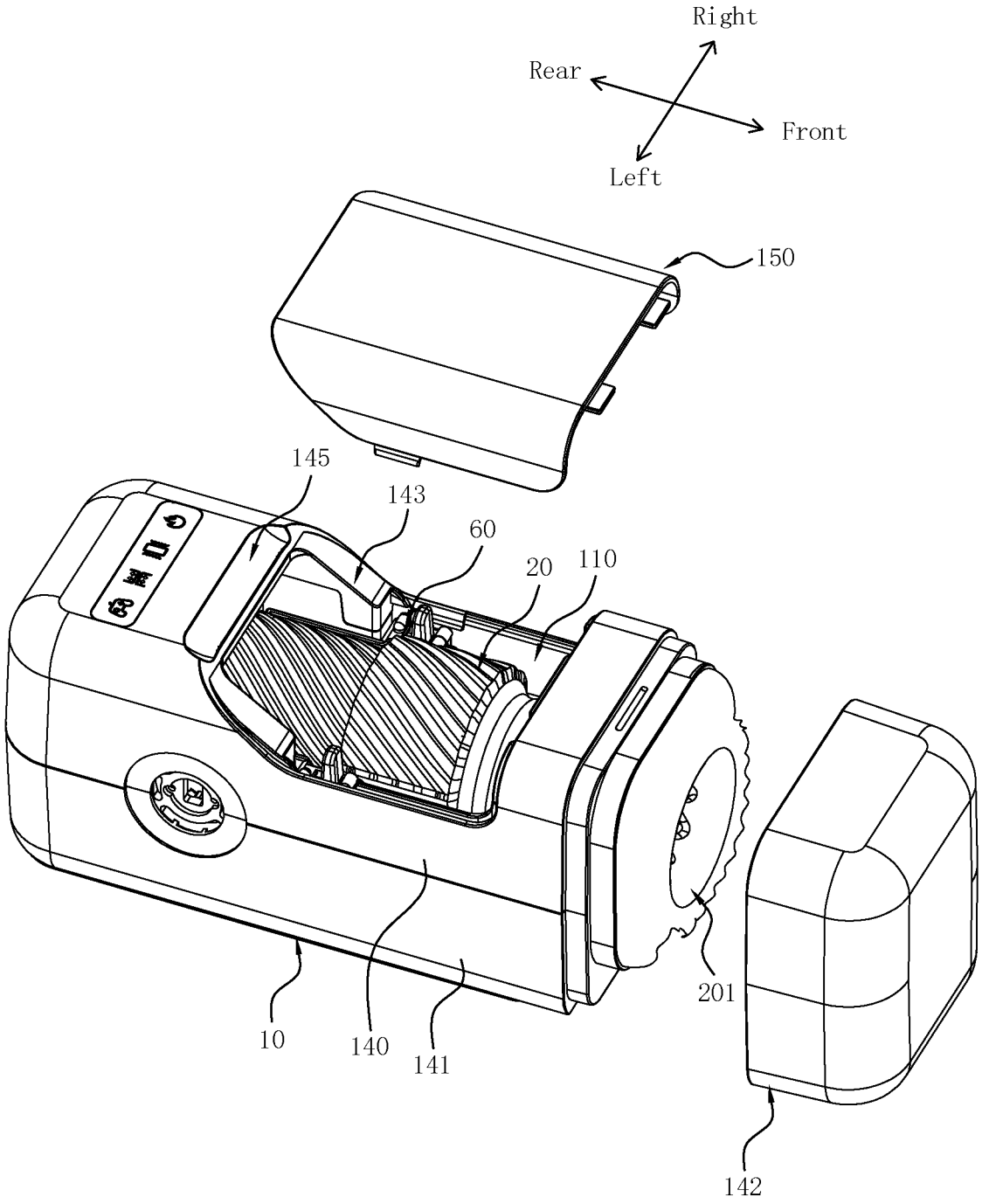
FIG. 3 is a first schematic partially-exploded view of the penis massager of FIG. 1.
Figure 4:
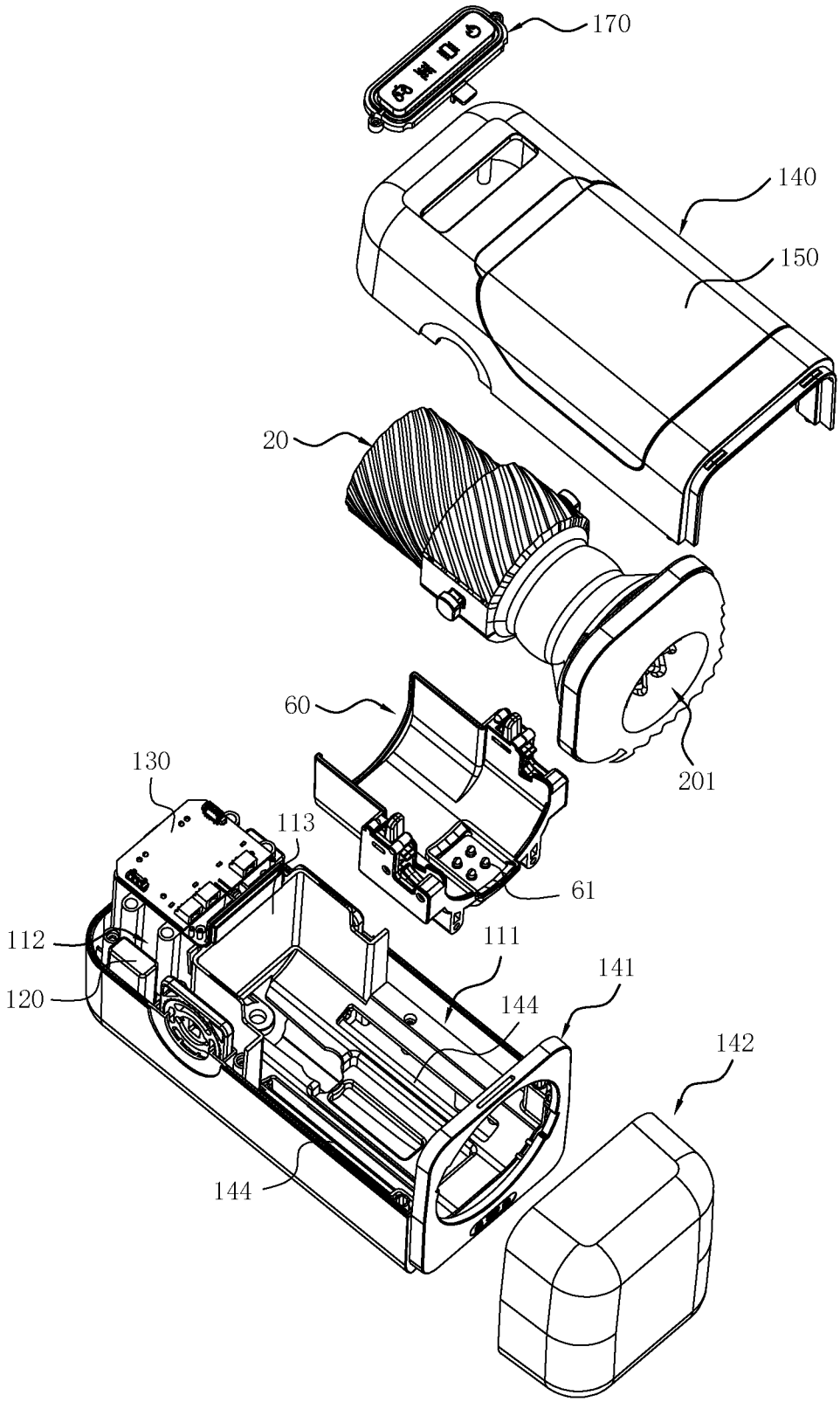
FIG. 4 is a second schematic partially-exploded view of the penis massager of FIG. 1.

With reference to FIG. 3 and FIG. 4, a partition plate 113 is arranged in the housing 10 and separates the accommodating space 110 into a first space 111 and a second space 112. The sleeve 20 is located in the first space 111, and the power source 120 and the circuit board 130 are located in the second space 112. The top housing 140 of the housing 10 is provided with a control panel 170 which is electrically connected to the circuit board 130, and corresponding functions of the penis massager may be started or stopped by pressing functional keys on the control panel 170. The power source 120 may be one or more rechargeable batteries.

Compared with the prior art, the penis massager provided by the present invention has the beneficial effects that: the penis massager of the present invention is configured to set the vibrating apparatus in the sleeve, so that the vibrating apparatus and the sleeve are integral, which makes the vibrating apparatus need not to be removed when the sleeve is cleaned. Thus, the penis massager is more convenient to clean after being used. In addition, the vibrating apparatus arranged in the sleeve, compared with a structure that the vibrating apparatus is arranged externally, is wider and more obvious in vibration range, thereby forming stronger stimulation and improving the user experience.

In a comparative example, a rear end of the interior volume of the sleeve is set to be narrower, and a rear end of the sleeve may be stretched. For such structure, the user cannot feel balanced wrap, and the head of the penis is excessively stimulated, so that the effect of massage exercise cannot be achieved. With reference to FIG. 7, in the present embodiment, the interior volume 210 in the sleeve 20 includes a first section 211, a second section 212 and a third section 213 in sequence, and widths of the first section 211 and the third section 213 both are set to be greater than the width of the second section 212. The second section 212 is used for encircling at least one part of the middle of the penis. In other words, a portion at a middle of the interior volume 210 in the sleeve 20 is narrower, in this way, the effect of holding the middle section to push and pull during real use may be imitated, the whole penis may be completely wrapped by the sleeve 20 for friction, and thus, it is easier to achieve massage exercise.

Figure 2:
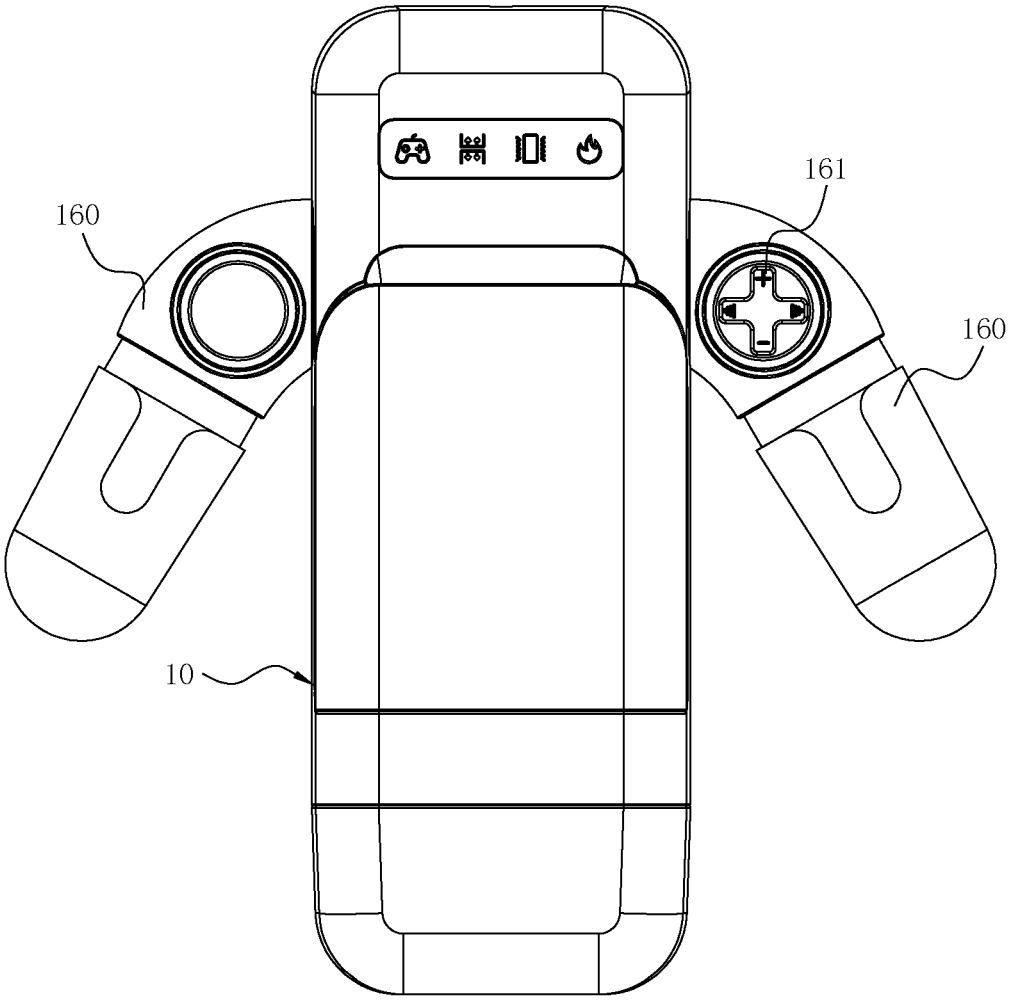
FIG. 2 is a top view of the penis massager of FIG. 1.

With reference to FIG. 1, FIG. 2 and FIG. 7, preferably, two handles 160 to be held by human hands are symmetrically arranged on left and right sides of the housing 10. The handles 160 are generally column-shaped, with domes provided at front ends thereof. A connecting portion between a rear end of the handle160 and the housing 10 is in smooth transition. The rear ends of the handles 160 are inclined to an axis direction of the housing 10, and included angles therebetween may be set to range from 30 degrees to 45 degrees. The handles 160 are arranged on two sides of the housing 10, and the user can adjust a placement angle of the penis massager through the handles 160, so that the penis massager is adjusted to an appropriate posture to bright convenience for the user.

The handles 160 are provided with keys 161 for adjusting a vibration amplitude of the vibrating apparatus 30. At least two keys 161 are arranged on one of the handles 160, and the vibration amplitude of the vibrating apparatus 30 may be adjusted to increase by one of the keys 161 and may be adjusted to decrease by the other one of the keys 161.

In the present embodiment, with reference to FIG. 3 and FIG. 5 to FIG. 7, a fixed frame 40 is arranged in the sleeve 20. That is, the fixed frame 40 and the sleeve 20 are integrally molded by injection. The fixed frame 40 may be specifically arranged in the side wall of the sleeve 20. A plurality of conductive columns 410 are arranged on the fixed frame 40. The vibrating apparatus 30 includes the motor 31. An outer housing is mounted around the motor 31, and includes a housing body 32 and a housing cover 33. The vibrating apparatus 30 is electrically connected to the conductive columns 410 through a first wire. A plurality of conductive members 61 are arranged in the accommodating space 110 of the housing 10. The conductive members 61 may be but are not limited to conductive pogo pins, conductive springs or magnetic attraction members. The conductive members 61 are electrically connected to the circuit board 130. One end of each conductive column 410 is electrically connected to one of the conductive members 61 after extending out of the sleeve 20, thereby realizing electric conduction between the vibrating apparatus 30 and the circuit board 130.

In a comparative example, a heating element is arranged on an outer side wall of the sleeve and is fixed by a mounting frame. Thus, the heating element is attached to the outer side wall of the sleeve. Such construction with the heating member out of the sleeve has problems of slow rising in heating temperature and uneven temperature distribution. With reference to FIG. 6 and FIG. 7, in the present embodiment, the sleeve 20 is internally provided with a heating plate 50, that is, the sleeve 20 and the heating plate 50 are set to be integral, and specifically the heating plate 50 may be embedded into the side wall of the sleeve 20. The heating plate 50 at least covers a part of a side wall of a middle area of the sleeve 20. The heating plate 50 is arranged in the sleeve 20, so that the heating plate 50 may be wrapped inside the side wall of the sleeve 20, and then, heat of the heating plate 50 can be transfer to the sleeve 20 rapidly.

When a heating function of the penis massager is started, the sleeve 20 may be kept at a constant temperature within a certain range, and thus, the user can achieve more realistic experience and a better effect during massage exercise and sperm extraction. The heating plate 50 is electrically connected to the rest of the conductive columns 410 through a second wire, one end of each conductive column 410 is electrically connected to the conductive members 61, and thus, a circuit between the heating plate 50 and the circuit board 130 is conducted. In the present embodiment, the conductive members 61 and the conductive columns 410 are wirelessly connected, either between the motor 31 and the circuit board 130 or between the heating plate 50 and the circuit board 130, so that wire connection is reduced, and it is convenience in use. Moreover, the sleeve 20 has no wires exposed for connection, and thus, after being used, the sleeve 20 is more conveniently taken out to clean without restrictions of the wires.

Preferably, a longitudinal cross section of the heating plate 50 is set to be C-shaped. The width of the heating plate 50 may be set according to the overall length of the sleeve 20. A position of the heating plate 50 corresponds to an area of the interior volume 210 of the sleeve 20 in which the second section 212 is located.

Specifically, the heating plate 50 is fixed on an inner wall surface of the fixed frame 40. A longitudinal cross section of the fixed frame 40 is also C-shaped, and an overall dimension of the fixed frame 40 is slightly greater than that of the heating plate 50. The heating plate 50 and the fixed frame 40 may be fixed by a snap-fit structure or fixed together by a connecting member or in other ways. Locating protrusions 441 are arranged on the inner wall surface of the fixed frame 40, and locating gaps 510 are defined in positions of the heating plate 50 corresponding to the locating protrusions 441. The heating plate 50 is preliminarily mounted on the fixed frame 40 by cooperating of the locating protrusions 441 and the locating gaps 510, and then, the heating plate 50 is fixed on a fixing member by a connecting member. After the heating plate 50 and the fixed frame 40 are fixed together, the fixed frame 40 and the sleeve 20 are integrally molded by injection.

Figure 8:
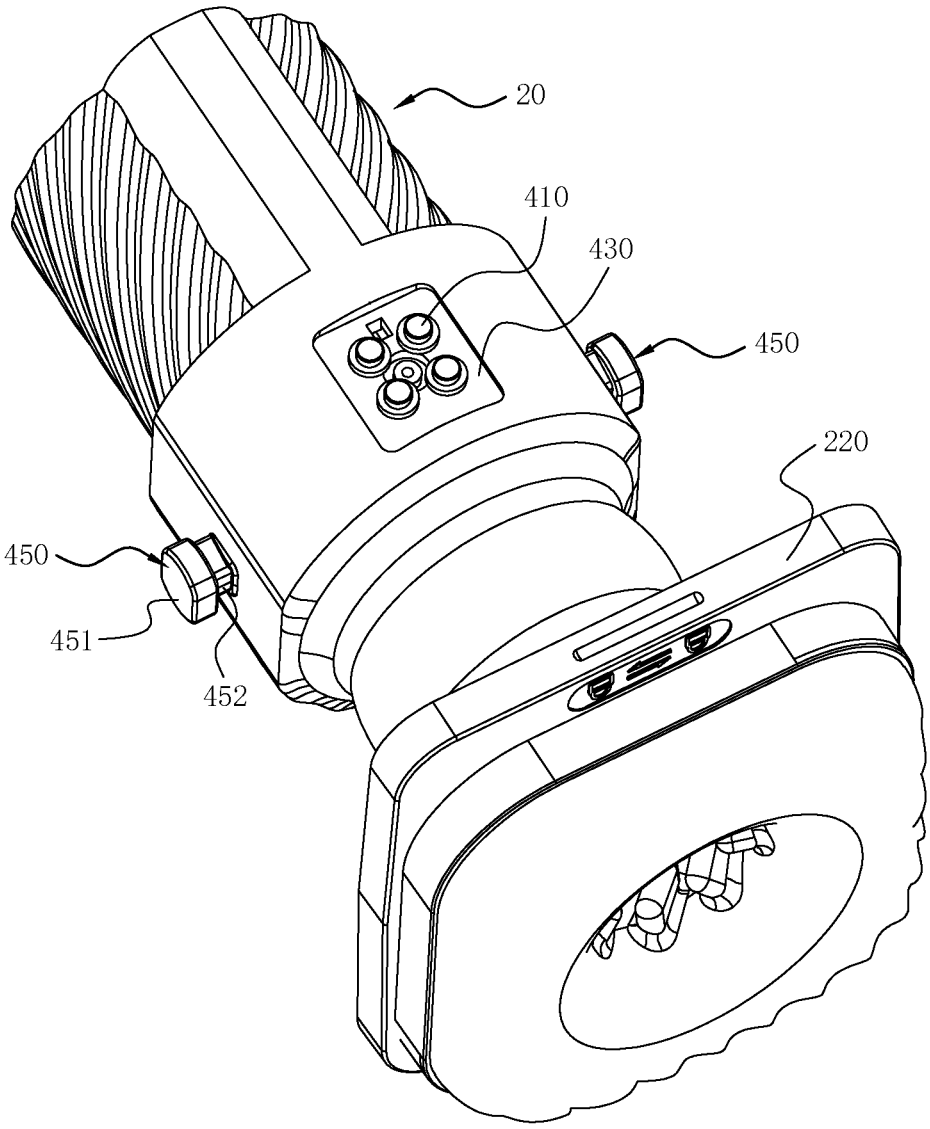
FIG. 8 is a perspective view of the sleeve of from another aspect.

With reference to FIG. 4, FIG. 6 and FIG. 8, preferably, the conductive members 61 are electrified by contact with the conductive columns 410, which may be implemented by elastic conductive members. At least one of the conductive member 61 and the conductive column 410 is an elastic conductive member or provided with an elastic conductive member. In the present embodiment, the conductive members 61 are conductive pogo pins 610. Springs are arranged in the conductive pogo pins 610, so as to form elastic contact between the conductive pogo pins 610 and the conductive columns 410. Therefore, power off caused by loosening of the contact during movement of the sleeve 20 may be avoided.

Preferably, the fixed frame 40 has a hollow structure, and thus, the fixed frame 40 and the sleeve 20 may be more stably combined together after being molded by injection. The fixed frame 40 is provided with a plurality of strip-shaped through holes 440, and the through holes 440 construct the hollow structure of the fixed frame 40, so that not only the structural strength of the fixed frame 40 may be ensured, but also the fixed frame 40 and the sleeve 20 may be stably combined together after being molded by injection.

Figure 9:
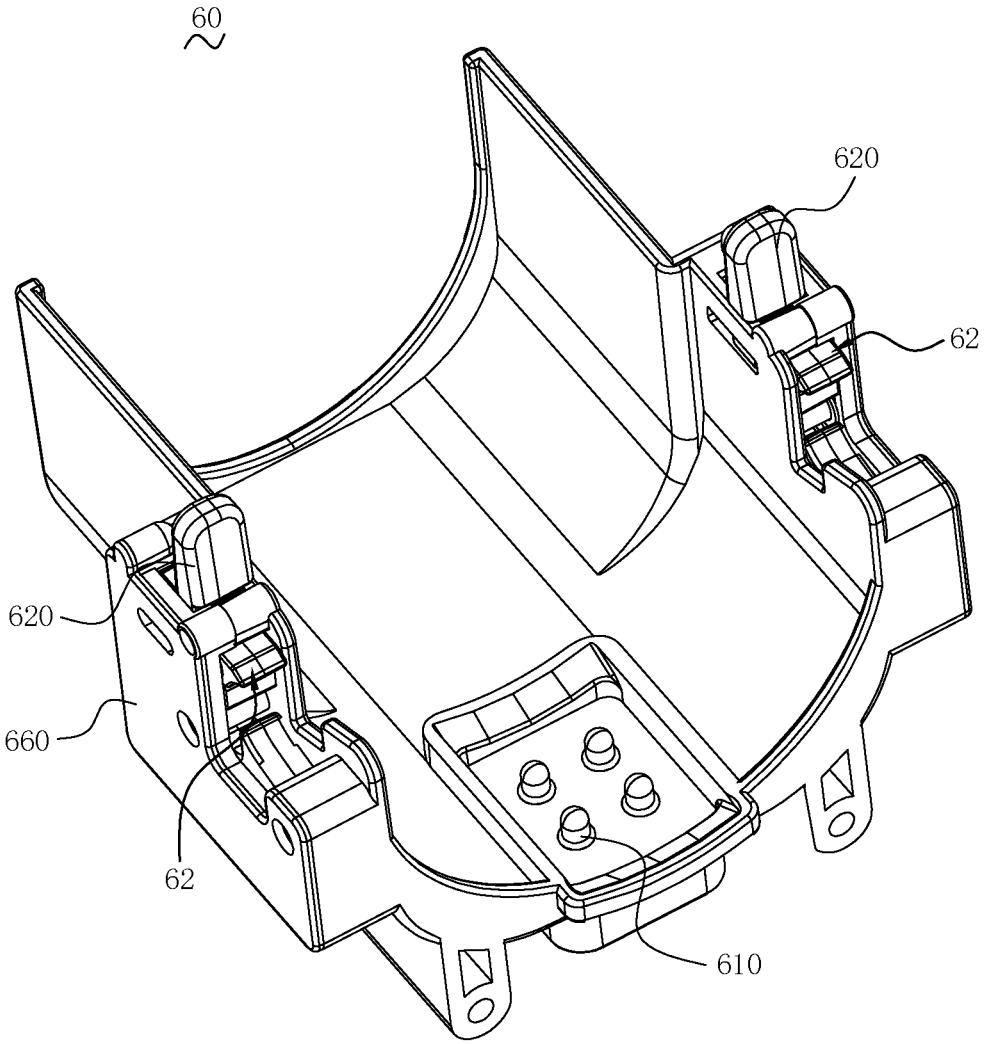
FIG. 9 is a perspective view of a movable cabin of the penis massager of FIG. 4.

With reference to FIG. 3, FIG. 4 and FIG. 9, a movable cabin 60 is arranged in the accommodating space 110, and is capable of sliding back and forth in the axial direction of the accommodating space 110. A longitudinal cross section of the movable cabin 60 is generally U-shaped, and opened at its front, rear and top ends. The sleeve 20 is removably arranged on the movable cabin 60, and the length of the movable cabin 60 is less than that of the sleeve 20. The conductive members 61 are fixed on the movable cabin 60. Specifically, sliding bars 144 are respectively arranged on left and right sides of the housing 10, close to the bottom of the first space 111, and the sliding bars 144 extend in the axial direction of the housing 10 and slidably penetrate through the movable cabin 60. In this way, the movable cabin 60 is in sliding fit with the sliding bars 144, and the movable cabin 60 is capable of sliding back and forth along the sliding bars 144. That is, the movable cabin 60 is capable of sliding for a certain distance in the first space 111.

After the vibrating apparatus 30 is started, the sleeve 20 and the movable cabin 60 move together in the first space 111 in the axial direction of the housing 10. The conductive members 61 are conductive pogo pins 610, holes for mounting the conductive pogo pins 610 are defined in the bottom of the movable cabin 60, and the conductive pogo pins 610 pass through the holes to extend into the movable cabin 60. A bottom cover 680 is arranged on an outer bottom surface of the movable cabin 60, and a screw is adopted to penetrate through the bottom cover 680 to fix it onto the movable cabin 60, and thus the conductive pogo pins 610 are locked and fixed on the movable cabin 60.

Figure 10:
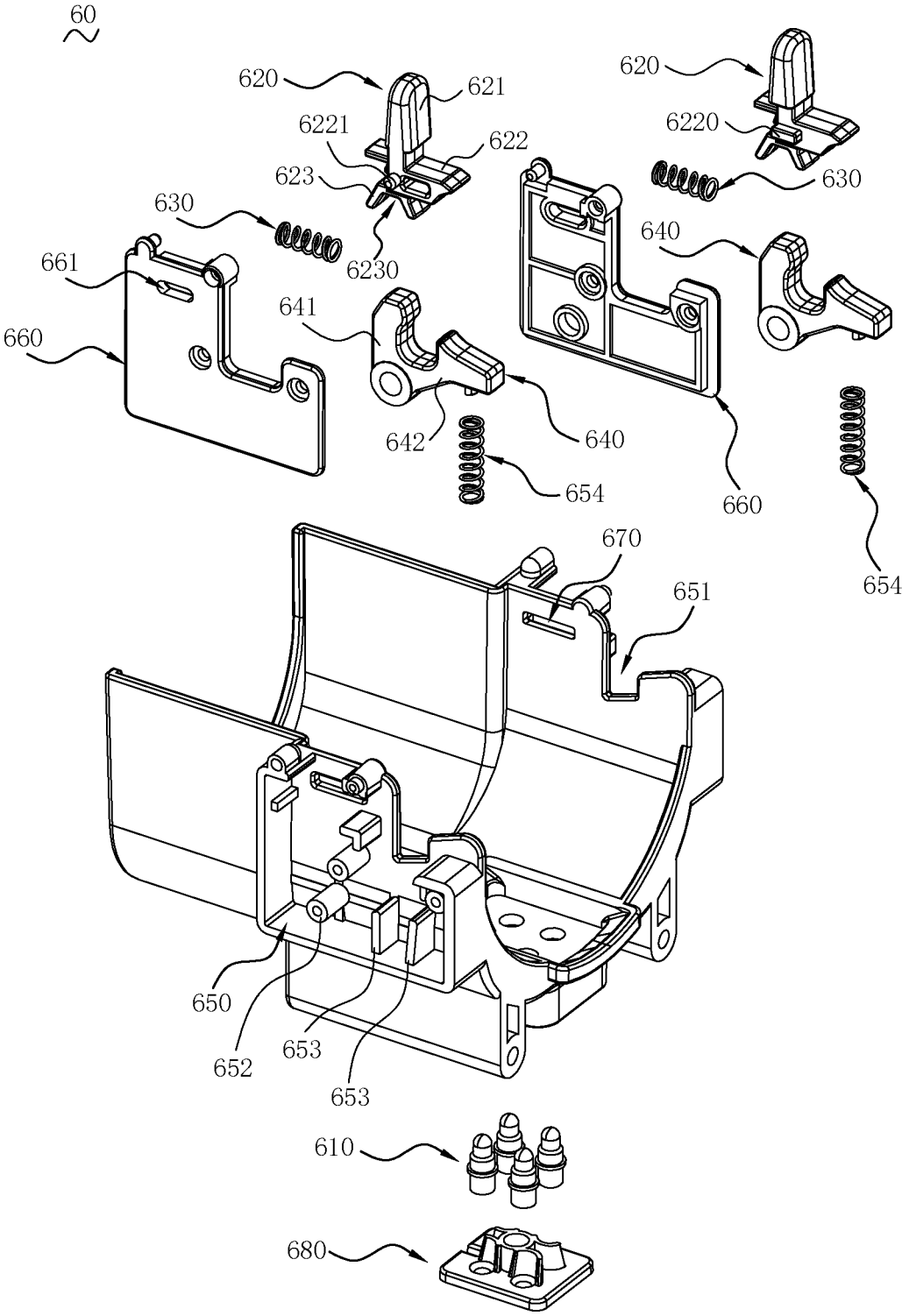
FIG. 10 is an exploded view of the movable cabin of FIG. 9.

Specifically, in the present embodiment, with reference to FIG. 9 and FIG. 10, the number of the conductive columns 410 and the number of the conductive pogo pins 610 are both four, a mounting area 420 is arranged on the bottom of an outer wall surface of the fixed frame 40, a bottom surface of the mounting area 420 is a plane, and the four conductive columns 410 are fixed on the bottom surface of the mounting area 420. The motor 31 is electrically connected to two of the conductive columns 410 by the first wire, and the heating plate 50 is electrically connected to the other two conductive columns 410 by the second wire.

With reference to FIG. 6, FIG. 7 and FIG. 9, four stepped holes 421 are defined in the mounting area 420. A flange 411 protrudes radially and outwards from an outer circumferential surface of the conductive column 410 and abuts against a step surface of one corresponding stepped hole 421. The fixed frame 40 is provided with a bottom cover 430, the bottom cover 430 is fixed in the mounting area 420 by a screw 432, and thus, the conductive columns 410 are locked and fixed in the mounting area 420. Four through holes are defined in the bottom cover 430, and one end of each conductive column 410 abuts against the conductive pogo pin 610 after passing through the through hole. Preferably, an annular sealing ring is tightly pressed between the bottom cover 430 and the mounting area 420, and thus, a waterproof effect of the mounting area 420 may be improved.

Preferably, insulating layers are provided on outer surfaces of the other ends of the conductive columns 410, an outer surface of the first wire, an outer surface of the second wire, a connection between the first wire and each of the conductive columns 410 and a connection between the second wire and each of the conductive columns 410, respectively. During specific operation, after the first wire is welded to the conductive columns 410 and the second wire is welded to the conductive columns 410, insulating glue is applied to cover surfaces of the first wire, the second wire and the other ends of the conductive columns 410 as well as welding point interfaces of each wire on the conductive columns 410, and then, the bottom cover 430 covers the mounting area 420, the screw 432 is adopted to lock and fix the bottom cover 430 in the mounting area 420. In this way, all the conductive columns 410 are tightly pressed, so that all the assemblies are integrated with the sleeve 20, and the motor 31, the heating plate 50 and the conductive columns 410 which are arranged in the sleeve 20 form a conductive path. The bottom cover 430 is further provided with an elastic sealing gasket 433, after the screw 432 locks the bottom cover 430, the sealing gasket 433 is inserted into a hole corresponding to the screw 432, and thus, the sealing gasket 433 shields the screw 432 and seals the hole to prevent a cleaning solution from entering the hole when the sleeve 20 is cleaned.

With reference to FIG. 4 to FIG. 6, preferably, the fixed frame 40 is provided with clamping blocks 450 which extend out of an outer side wall of the sleeve 20. Clamping structures switchable between a locking state and an unlocking state are formed between the movable cabin 60 and each of the clamping blocks 450. When the clamping structures are in the locking state, the sleeve 20 is clamped and fixed in the movable cabin 60 by the clamping blocks 450. When the clamping structures are in the unlocking state, the sleeve 20 may be taken out of the movable cabin 60.

With reference to FIG. 3, FIG. 5, FIG. 9 and FIG. 10, linkage assemblies 62 are symmetrically arranged on left and right sides of the movable cabin 60. Each of the linkage assemblies 62 and the clamping block 450 on the corresponding side cooperatively construct a clamping structure. The linkage assembly 62 includes a toggling member 620, an elastic member 630 and a bent lever 640. The toggling members 620 are movably arranged on the movable cabin 60 and are capable of sliding or rotating relative to the movable cabin 60. The bent levers 640 are rotatably arranged on the movable cabin 60. The elastic members 630 are abutted between each of the toggling members 620 and the movable cabin 60, and the clamping blocks 450 are clamped and fixed by the toggling members 620 and the bent levers 640 under the action of elasticities provided by the elastic members 630. When the toggling members 620 are toggled in an unlocking direction, the toggling members 620 are capable of driving the bent levers 640 to rotate, so that the clamping structures are in the unlocking state, and the sleeve 20 is in a state being capable of taken out of the housing 10.

Figure 11:
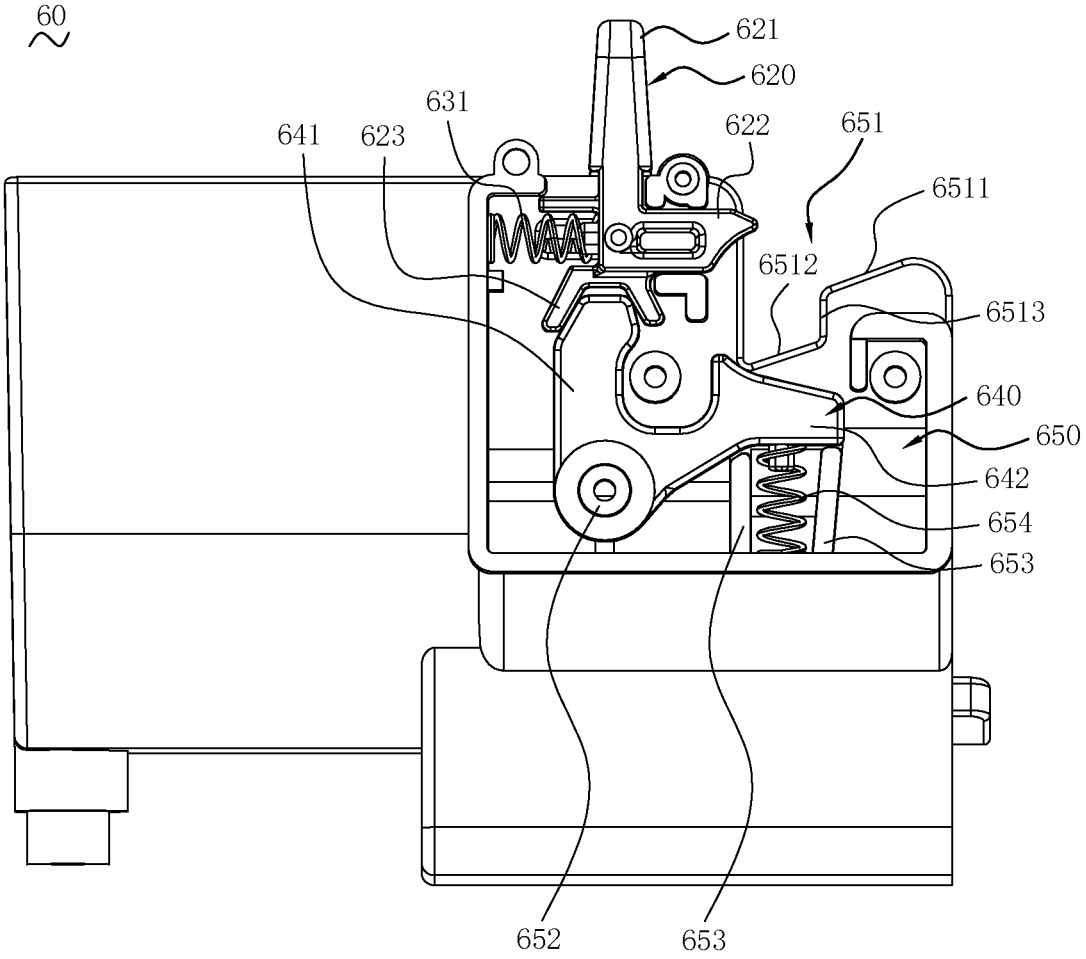
FIG. 11 is a side view of the movable cabin of FIG. 9.
Figure 12:
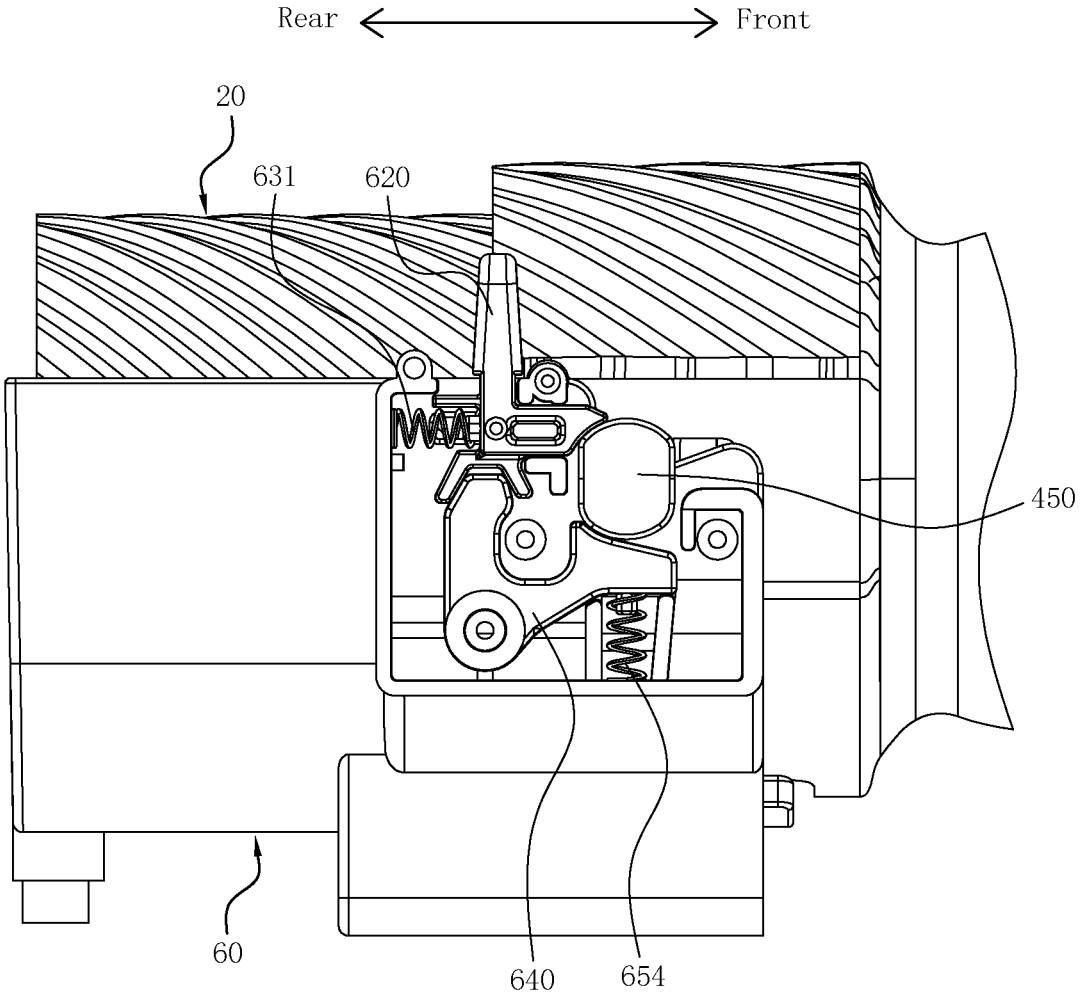
FIG. 12 is a schematic, assembled view of the sleeve and the movable cabin.

With reference to FIG. 10 to FIG. 12, specifically, mounting slots 650 are symmetrically defined in outer side walls of the left and right sides of the movable cabin 60, the elastic members 630 and the bent levers 640 are accommodated in the mounting slots 650, and parts of the toggling members 620 are accommodated in the mounting slots 650. The mounting slots 650 are provided with gaps 651 to be penetrated by the clamping blocks 450, and the clamping blocks 450 extend through the gaps 651 to insert into the mounting slots 650. Clamping positions are respectively formed near the gaps 651 in two sides of the movable cabin 60, and when the linkage assemblies 62 are in the locking state, the clamping blocks 450 are clamped into the mounting slots 650 by the toggling members 620, the bent levers 640 and portions of the slot walls of the mounting slots 650 at the gaps 651. After the toggling members 620 on the left and right sides of the movable cabin 60 are toggled in the unlocking direction, the toggling members 620 leave from the clamping blocks 450, at the moment, the toggling members 620 are spaced from the clamping blocks 450, and thus, the clamping structures are in the unlocking state.

The toggling member 620 includes an operating portion 621, a clamping portion 622 and a toggling portion 623, which are connected together in sequence. One end of each operating portions 621 extends out of a top of the mounting slot 650 to form an operating end to be toggled by hands. Convex blocks 6220 and convex shafts 6221 are respectively arranged on left and right sides of the clamping portions 622, detachable side covers 660 are arranged on positions of the movable cabin 60 corresponding to the mounting slots 650, first sliding chutes 661 are arranged in positions of the side covers 660 corresponding to the convex shafts 6221, the convex shafts 6221 are slidably connected to the first sliding chutes 661, second sliding chutes 670 are arranged in positions of the movable cabin 60 corresponding to the convex blocks 6220, the convex blocks 6220 are slidably connected to the second sliding chutes 670, and thus, a sliding connection between each of the clamping portions 622 and the movable cabin 60 is achieved. In other words, the toggling members 620 are slidably connected to the movable cabin 60, and when the operating ends of the operating portions 621 are toggled backwards, the toggling members 620 as a whole can backwards slide for a certain distance.

The elastic members 630 adopt first compression springs 631. One end of each clamping portion abuts against the clamping blocks 450, and the other end of the clamping portion 622 is provided with a fixing column. One end of each first compression spring 631 is mounted around the fixing column, and thus, the clamping portions 622 abut against the first compression springs 631. The other ends of the first compression springs 631 abut against side walls of the mounting slots 650. Locating slots 6230 which are generally splay-shaped are encircled by the toggling portions 623. That is, left, right and bottom sides of the locating slots 6230 are opened, and inner side walls of the toggling portions 623 cooperatively define the locating slots therebetween. Corners of the locating slots 6230 are set to be in smooth transition. The mounting slots 650 are internally provided with mounting columns 652. The bent lever 640 includes a first link levers 641 and second link lever 642. Bent parts where the first link levers 641 are connected to the second link levers 642 are rotatably mounted on the mounting columns 652, that is, the bent levers 640 are rotatably arranged in the mounting slots 650 through the mounting columns 652, and the bent levers 640 are capable of rotating with the mounting columns 652 as fulcrums. Ends, away from the mounting columns 652, of the first link levers 641 extend into the locating slots 6230, and ends, away from the mounting columns 652, of the second link levers 642 abut against the clamping blocks 450.

With reference to FIG. 3, FIG. 8 and FIG. 10 to FIG. 12, specifically, the clamping blocks 450 are provided with connected large-diameter ends 451 and small-diameter ends 452, and widths of the large-diameter ends 451 are greater than those of the small-diameter ends 452. Contours of longitudinal sections of the large-diameter ends 451 are similar to ellipses, and bottom and top ends thereof are both arc surfaces. One end of each of the small-diameter ends 452 is connected to the fixed frame 40. When the sleeve 20 is mounted in the housing 10, the small-diameter ends 452 are tightly abutted against wall surfaces of the gaps 651 of the movable cabin 60. The clamping portions 622 of the toggling members 620 abut against one side on the top of each of the large-diameter ends 451 under the action of elasticities of the first compression springs 631, sides, close to the large-diameter ends 451, of the clamping portions 622 are adaptive arc surfaces, and thus, the clamping portions 622 are fitted to one side on the top of each of the large-diameter ends 451. As shown in FIG. 8, FIG. 11 and FIG. 12, the clamping structures are in the locking state, the clamping portions 622 and the second link levers 642 are both abutted against the large-diameter ends 451 of the clamping blocks 450, the wall surfaces in the gaps 651 of the movable cabin 60 abut against the small-diameter ends 452 of the clamping blocks 450, the clamping blocks 450 are stressed at the same time in three directions, i.e. upper left sides, lower right sides and right sides, and thus, triangular stressed structures are formed on the clamping positions, the clamping blocks 450 may be stably clamped, and then, the sleeve 20 is stably buckled together after being pressed into the movable cabin 60.

With reference to FIG. 10 to FIG. 12, preferably, the gaps 651 in the left and right sides of the movable cabin 60 are both U-shaped gaps. The movable cabin 60 are provided with unfilled corners on front ends of the U-shaped gaps, that is, horizontal positions on tops of wall surfaces on front ends of the U-shaped gaps are lower than horizontal positions on tops of wall surfaces on rear ends thereof. First inclined surfaces 6511 are arranged on the wall surfaces on the front ends of the U-shaped gaps, and thus, the operation of downwards pressing the sleeve 20 to be put into the movable cabin 60 is facilitated. When the sleeve 20 is mounted, the small-diameter ends 452 of the clamping blocks 450 slide into the U-shaped gaps along the first inclined surfaces 6511, that is, the first inclined surfaces 6511 form guide surfaces by which the clamping blocks 450 are convenient to slide into the U-shaped gaps. Second inclined surfaces 6512 are arranged on bottoms of the U-shaped gaps, front ends of the second inclined surfaces 6512 are inclined upwards, clamping surfaces 6513 are connected between each of the first inclined surfaces 6511 and each of the second inclined surfaces 6512, and the clamping surfaces 6513 are arranged vertically. In this way, when the sleeve 20 is pressed and mounted into the movable cabin 60, the clamping blocks 450 are clamped into the bottoms of the U-shaped gaps, bottoms of the small-diameter ends 452 of the clamping blocks 450 abut against the second inclined surfaces 6512, and one side of each of the small-diameter ends 452 abuts against the clamping surface 6513. Each wall surface in the U-shaped gaps can adopt an arc surface, and thus, it is convenient for the clamping blocks 450 to slide in or out, and the clamping blocks 450 can also be prevented from being scratched.

With reference to FIG. 6 and FIG. 10 to FIG. 12, when the sleeve 20 is mounted, the conductive columns 410 in the mounting area 420 on the bottom of the sleeve 20 are aligned with the conductive pogo pins 610, the clamping blocks 450 on the left and right sides are aligned with the U-shaped gaps in the two sides of the movable cabin 60, the sleeve 20 is downwards pressed into the movable cabin 60, the toggling members 620 on the left and right sides of the movable cabin 60 move backwards, the first compression springs 631 are compressed, after the sleeve 20 is clamped in place, the toggling members 620 automatically return due to the elasticities of the first compression springs 631, at the same time, the toggling members 620 drive the bent levers 640 to rotate, the second link levers 642 are bounced upwards, then, triangular buckling positions are formed in the U-shaped gaps, the clamping blocks 450 are tightly clamped, the clamping structures are in the locking state, and thus, the sleeve 20 is clamped and fixed in the movable cabin 60.

Figure 13:
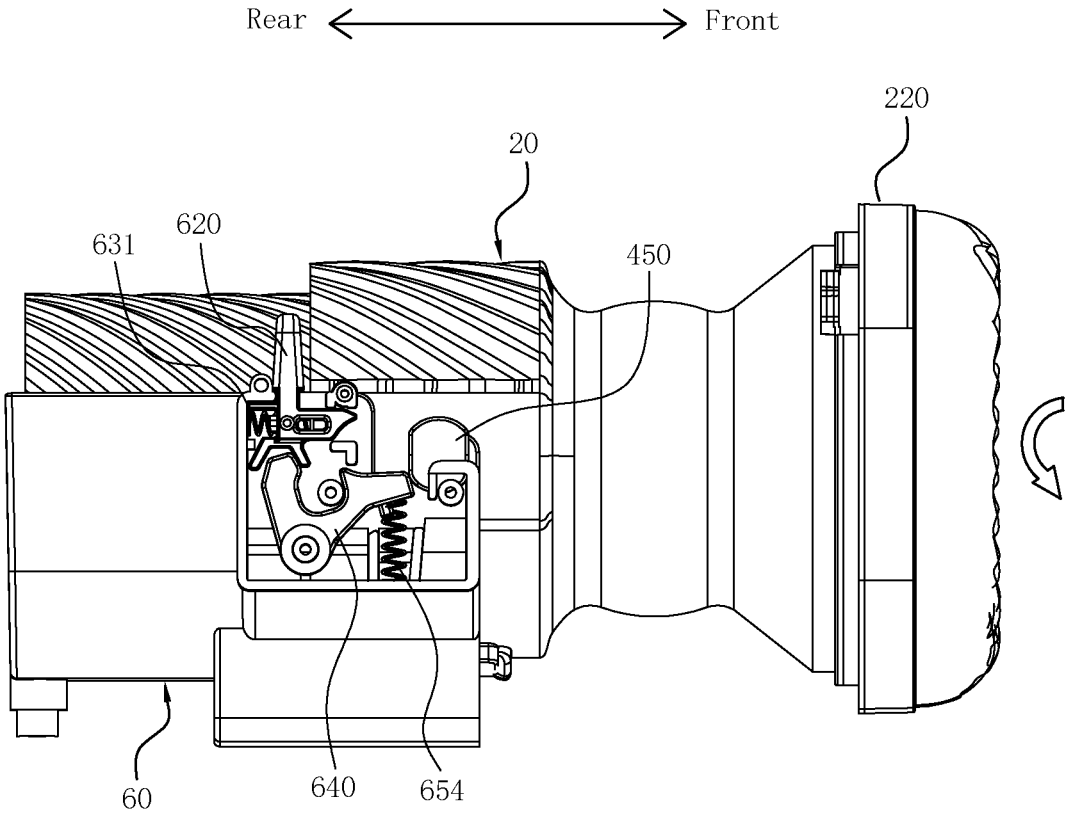
FIG. 13 is a schematic view showing an operation of removing the sleeve from the movable cabin.

In a comparative example, a magnet is arranged in the bottom of the sleeve, a magnet is also arranged on a corresponding position of the housing, and thus, a magnetic absorption structure is formed; and when the sleeve is taken out of the housing, the sleeve is easily damaged after being stretched. With reference to FIG. 11 to FIG. 13, in the present embodiment, when the sleeve 20 is required to be taken out of the movable cabin 60, the toggling members 620 on the left and right sides of the movable cabin 60 are toggled to rear ends, the first compression springs 631 are compressed, the clamping portions 622 of the toggling members 620 leave from the clamping blocks 450, the toggling members 620 drive a crankshaft to rotate counterclockwise around the mounting columns 652 through the splay locating slots 6230 in the bottoms, and the second link levers 642 upwards jack the clamping blocks 450, so that the clamping blocks 450 come out of the gaps 651 of the movable cabin 60, at the moment, the sleeve 20 is bounced upwards together with the fixed frame 40, the four conductive pogo pins 610 on the bottom of the movable cabin 60 are bounced under pressures of the springs thereof, the fixing member 220 is held to rotate downwards, a buckling position of the fixing member 220 is released, and thus, the sleeve 20 may be pulled out. The sleeve 20 is relatively convenient to dismount and mount; when being pressed downwards, the sleeve 20 may be stably clamped together with the movable cabin 60; and by backwards pushing the toggling members 620 on two sides, the sleeve 20 may be bounced from the movable cabin 60, so that the problem that the sleeve 20 is pulled hard to be damaged may be effectively avoided.

With reference to FIG. 11 to FIG. 13, two limiting blocks 653 are spaced on the slot wall on the bottom of each of the mounting slots 650, and second compression springs 654 are arranged between the two limiting blocks 653. Connecting columns are arranged on surfaces away from the second link levers 642 and abutted against the clamping blocks 450, one end of each of the second compression springs 654 sleeves the connecting columns, and the other ends of the second compression springs 654 abut against the slot walls on the bottoms of the mounting slots 650. The elasticities of the second compression springs 654 are smaller than those of the first compression springs 631, and thus, the bent levers 640 may not automatically rotate under the abutment of the second compression springs 654, i.e., the clamping structures may not switched from the locking state to the unlocking state due to the second compression springs 654. When the clamping structures are in the locking state, the second link levers 642 abut against top ends of the two limiting blocks, and the second compression springs 654 are tightly pressed to be accommodated between the two limiting blocks 653. When the clamping structures are in the unlocking state, the second link levers 642 leave from the two limiting blocks 653, the second compression springs 654 stretch and provide forces for upwards ejecting the second link levers 642, so that the toggling members 620 may be toggled backwards with less forces before the sleeve 20 is pressed and mounted in the movable cabin 60, and then, the toggling operation is easier.

The above is only a better embodiment of the present invention and is not intended to limit the present invention. Any modification, equivalent replacement and improvement made within the spirit and principle of the present invention shall be included in a scope of protection of the present invention.

What is claimed is:

1. A penis massager, comprising:

a housing provided with an accommodating space, a power source and a circuit board electrically connected to the power source being received in the accommodating space;

a sleeve being removably mounted in the accommodating space, one end of the sleeve being concaved to form an interior volume for accommodating a penis; and a vibrating apparatus being provided in the sleeve, the vibrating apparatus being electrically connected to the circuit board for generating a mechanical vibration;

wherein the sleeve is provided with a fixed frame, at least one conductive element is provided on the fixed frame, the vibrating apparatus is electrically connected to the at least one conductive element through a first wire; at least one conductive member is provided in the accommodating space and electrically connected to the circuit board, and the at least one conductive element is connected to the at least one conductive member electrically.

2. The penis massager according to claim 1, wherein the at least one conductive element comprises a plurality of conductive elements, the vibrating apparatus is electrically connected to at least one of the plurality of conductive elements through the first wire, a heating plate is provided in the sleeve and electrically connected to at least one of the plurality of conductive elements through a second wire.

3. The penis massager according to claim 2, wherein the heating plate is fixed on an inner wall surface of the fixed frame.

4. The penis massager of claim 2, wherein a plurality of insulating layers are covered on outer surfaces of ends of the plurality of conductive elements, an outer surface of the first wire, an outer surface of the second wire, a connection between the first wire and each of the plurality of conductive elements and a connection between the second wire and each of the plurality of conductive elements, respectively.

5. The penis massager according to claim 2, wherein the at least one conductive member comprises a plurality of conductive members, the plurality of conductive members and the plurality of conductive elements are electrically connected by contact.

6. The penis massager according to claim 5, wherein the electrical connection by contact is implemented by elastic conductive members.

7. The penis massager according to claim 6, wherein the elastic conductive members are conductive pogo pins.

8. The penis massager according to claim 7, wherein the number of the plurality of conductive elements and the number of the conductive pogo pins are both four, a mounting area is formed on a bottom of an outer wall surface of the fixed frame, the four conductive elements are fixed in the mounting area, the vibrating apparatus is electrically connected to two of the four conductive elements by the first wire, and the heating plate is electrically connected to the other two of the four conductive elements by the second wire.

9. The penis massager according to claim 8, wherein four stepped holes are formed in the mounting area, a flange protrudes radially and outwards from an outer circumferential surface of each of the plurality of conductive elements and abuts against a step surface of a corresponding stepped hole; the fixed frame is provided with a bottom cover, the bottom cover is fixed in the mounting area for fixing the plurality of conductive elements in the mounting area, four through holes are formed in the bottom cover, and one end of each of the plurality of conductive elements extends through one of the four through holes to abut against one of the plurality of conductive pogo pins.

10. The penis massager according to claim 1, wherein the fixed frame is a hollow structure.

11. The penis massager according to claim 1, wherein a movable cabin is movably arranged in the accommodating space, the movable cabin is capable of sliding back and forth in an axial direction of the accommodating space, a longitudinal cross section of the movable cabin is U-shaped, the sleeve is removably arranged on the movable cabin, and the at least one conductive member is fixed on a bottom of the movable cabin and extend into the movable cabin.

12. The penis massager according to claim 11, wherein the fixed frame is provided with a plurality of clamping blocks which extend out of an outer side wall of the sleeve; and each of the plurality of clamping blocks cooperates with the movable cabin to construct a clamping structure which has a locking state and an unlocking state, when the clamping structures are in the locking state, the sleeve is clamped and fixed in the movable cabin by the plurality of clamping blocks, and when the clamping structures are in the unlocking state, the sleeve is capable of being taken out of the movable cabin.

13. The penis massager according to claim 12, wherein the plurality of clamping blocks are symmetrically arranged on two sides of the fixed frame, and when the clamping structures on the two sides are both in the unlocking state, the sleeve is capable of being taken out of the movable cabin.

14. The penis massager according to claim 13, wherein a plurality of linkage assemblies are symmetrically arranged on two sides of the movable cabin, and each of the plurality of linkage assemblies and one of the plurality of clamping blocks on a corresponding side cooperatively construct the clamping structure;

each of the plurality of linkage assemblies comprise a toggling member, an elastic member and a bent lever, the toggling members are movably arranged on the movable cabin, the bent levers are rotatably arranged on the movable cabin, the elastic members are abutted between the toggling members and the movable cabin, and the plurality of clamping blocks are tightly clamped by the toggling members and the bent levers under the action of the elastic members; and when a force is applied to the toggling members in an unlocking direction, the toggling members are capable of driving the bent levers to rotate, so that the clamping structures are in the unlocking state.

15. The penis massager according to claim 14, wherein a plurality of mounting slots are symmetrically arranged on outer side walls on the two sides of the movable cabin, the elastic members and the bent levers are both accommodated in the plurality of mounting slots, and parts of the toggling members are accommodated in the plurality of mounting slots; the plurality of mounting slots are provided with gaps through which the plurality of clamping blocks extend into the plurality of mounting slots; when the plurality of linkage assemblies are in the locking state, the plurality of clamping blocks are clamped into the plurality of mounting slots by the toggling members, the bent levers and portions of slot walls of the plurality of mounting slots at in the gaps; and when the clamping structures are in the unlocking state, the toggling members are spaced from the plurality of clamping blocks.

16. The penis massager according to claim 15, wherein each of the plurality of toggling members comprises an operating portion, a clamping portion and toggling portion, one end of the operating portion extends out of a top of one of the plurality of mounting slots to form an operating end to be toggled by hands, the clamping portion is slidably connected to the movable cabin, one end of the clamping portion abuts against one of the plurality of clamping blocks, another end of the clamping portion abuts against one of the elastic members, and splay locating slots are defined by the toggling portions; and the plurality of mounting slots are internally provided with mounting elements, each of the bent levers comprises a first link lever and a second link lever which are connected to each other, a bent part where the first link lever is connected to the second link lever is rotatably mounted on one of the mounting elements, one end of the first link lever extends into one of the locating slots, and one end of the second link lever abuts against one of the plurality of clamping blocks.

17. The penis massager according to claim 1, wherein the interior volume comprises a first section, a second section and a third section in sequence, widths of the first section and third section both are greater than a width of the second section, and the second section is configured to encircle at least one part of a middle of the penis.

18. The penis massager according to claim 1, wherein two handles to be held by human hands are symmetrically arranged on two sides of the housing, respectively.

19. The penis massager according to claim 18, wherein the handles are provided with keys for adjusting a vibration amplitude of the vibrating apparatus.

20. The penis massager according to claim 1, wherein the at least one conductive element is conductive column, and extends out of the sleeve to contact the at least one conductive member.

* * * * *